United States Patent [19]

Brown et al.

[11] 4,010,004

[45] Mar. 1, 1977

[54] VELVET FABRIC

[75] Inventors: Perry H. Brown, Villa Park, Calif.; Maurice H. Tremblay, Cockeysville, Md.

[73] Assignee: Brunswick Corporation, Skokie, Ill.

[22] Filed: Aug. 6, 1975

[21] Appl. No.: 602,255

Related U.S. Application Data

[60] Division of Ser. No. 483,240, June 26, 1974, Pat. No. 3,953,913, which is a division of Ser. No. 418,116, June 21, 1973, Pat. No. 3,838,983, which is a continuation of Ser. No. 212,468, Nov. 27, 1971, abandoned, which is a continuation of Ser. No. 861,024, Sept. 25, 1969, abandoned.

[52] U.S. Cl. ..... 29/191.6; 139/391; 139/425 R

[51] Int. Cl.[2] ..... B21C 37/04; B21F 31/00; B23P 3/10

[58] Field of Search ..... 29/191, 191.6, 182.1, 29/182.2, 182.3; 428/85, 95, 97; 245/1, 2; 139/425 R, 391; 75/DIG. 1

[56] References Cited

UNITED STATES PATENTS

| | | | |
|---|---|---|---|
| 1,744,004 | 1/1930 | Hunt | 139/425 R |
| 2,302,003 | 11/1942 | Cadwell et al. | 57/157 AS |
| 3,288,175 | 11/1966 | Yalko | 139/425 R |
| 3,472,289 | 10/1969 | Webber et al. | 139/391 X |
| 3,513,297 | 5/1970 | Jordan | 139/391 UX |
| 3,562,374 | 2/1971 | Okamoto et al | 28/76 T |
| 3,582,444 | 6/1971 | Ngo et al. | 161/65 |
| 3,582,445 | 6/1971 | Okuhashi | 139/425 R |
| 3,690,606 | 9/1972 | Pall | 29/182.2 |
| 3,698,863 | 10/1972 | Roberts et al. | 29/191.6 |
| 3,461,513 | 8/1969 | Girard et al. | 28/72 P |

OTHER PUBLICATIONS

Webber, H. H.; *Modern Textiles Magazine*; "Metal Fibers, Their Processing and End-Uses", (May, 1966), pp. 72–75.

Barry, G. F.; *Modern Textiles Magazine; "Textile Applications of Metal Fibers" (June 1967), pp. 53–56.*

Barry, G. F., *Modern Textiles Magazine; "Carpet Static Control with Stainless Steel Fibers", (May 1969), pp. 64–67.*

*Primary Examiner*—L. Dewayne Rutledge
*Assistant Examiner*—Michael L. Lewis
*Attorney, Agent, or Firm*—John G. Heimovics

[57] ABSTRACT

A metallic velvet material comprising a woven textile pile fabric wherein at least a portion of the woven base fabric and/or the velvet surface-forming pile yarns is metallic. The metallic yarn may comprise a blended yarn formed of staple metal fibers and conventional nonmetallic textile fibers, or may be formed of continuous metal filament material. The metal fibers, or filaments, are preferably formed with rough unmachined, unburnished, fracture-free outer surfaces for improved retention in the velvet pile fabric.

23 Claims, 11 Drawing Figures

15
10

27
26
24
23
25
22

28

18
19
20
28

18(20)
21
(b)
(a)
14
16
13
10a
12 d
12
16
13

12
14
17
11
13
17
15
29
SINTERING

16

16
10b
17
14
17
17
13
13
a
12'
12
12'
12
13

VELVET FABRIC

CROSS-REFERENCE TO CO-PENDING APPLICATION

This application is a divisional application of our co-pending application Ser. No. 483,240, filed June 26, 1974 now Pat. No. 3,953,913, which was a co-pending divisional application of Ser. No. 418,116, filed June 21, 1973, now U.S. Pat. No. 3,838,983, which was a co-pending continuation application of Ser. No. 212,468, filed Nov. 27, 1971, now abandoned, which was a continuation application of our co-pending application Ser. No. 861,024, filed Sept. 25, 1969, now abandoned.

BACKGROUND OF THE INVENTION

1. Field of the Invention

This invention relates to textile structures and in particular to plush or velvet structures having at least a portion of the yarns therein formed of metallic material.

2. Description of the Prior Art

In the conventional velvet textile fabrics, a pile yarn is introduced into the woven warp and filling structure. The pile yarn is caused to extend away from the face to the warp and filling weave and is cut at its outer ends to define a plush or velvet pile surface. Conventionally, such velvet is formed of organic and/or synthetic materials, such as wool, cotton, plastics, etc.

SUMMARY OF THE INVENTION

The present invention comprehends the provision of such a plush or velvet pile fabric wherein at least a portion of the woven fabric and/or pile yarn is metallic. The invention comprehends the provision of the metallic portion of the textile in the form of small diameter metal filaments of fibers which may be blended with conventional textile materials or comprise the entire yarn. The metal filaments or fibers may have a diameter of down to 1 micron or smaller to provide desirable flexibility and uniformity of blend whereby the pile fabric may be formed by substantially conventional textile forming apparatus. The metal fibers may comprise staple length fibers or may comprise continuous filaments as desired. In the preferred form, the fibers or filaments may have a rough unmachined, unburnished, fracture-free outer surface for improved retention of the fibers in the pile fabric. The fibers may be metallic throughout, or may comprise nonmetallic fibers having an electrically conductive metallic coating.

The metal fibers and filaments may have further improved retention in the fabric by means of bonding thereof. Preferably, the bonding provides static discharge continuity. The bonding may be effected by metallurgical bonding means such as sintering, brazing, or welding operations and sacrificial materials may be employed for maintaining a desired association of the metal fibers and filaments. Alternatively, when adhesive bonding means are used, they may comprise electrically conductive adhesives. The particular metal material used may be preselected to provide desired color effects, wear, and abrasion, and other physical and chemical characteristics.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figures 1, 2, 3, 4, 5, 6, 7, 8, 9, 10, 11:
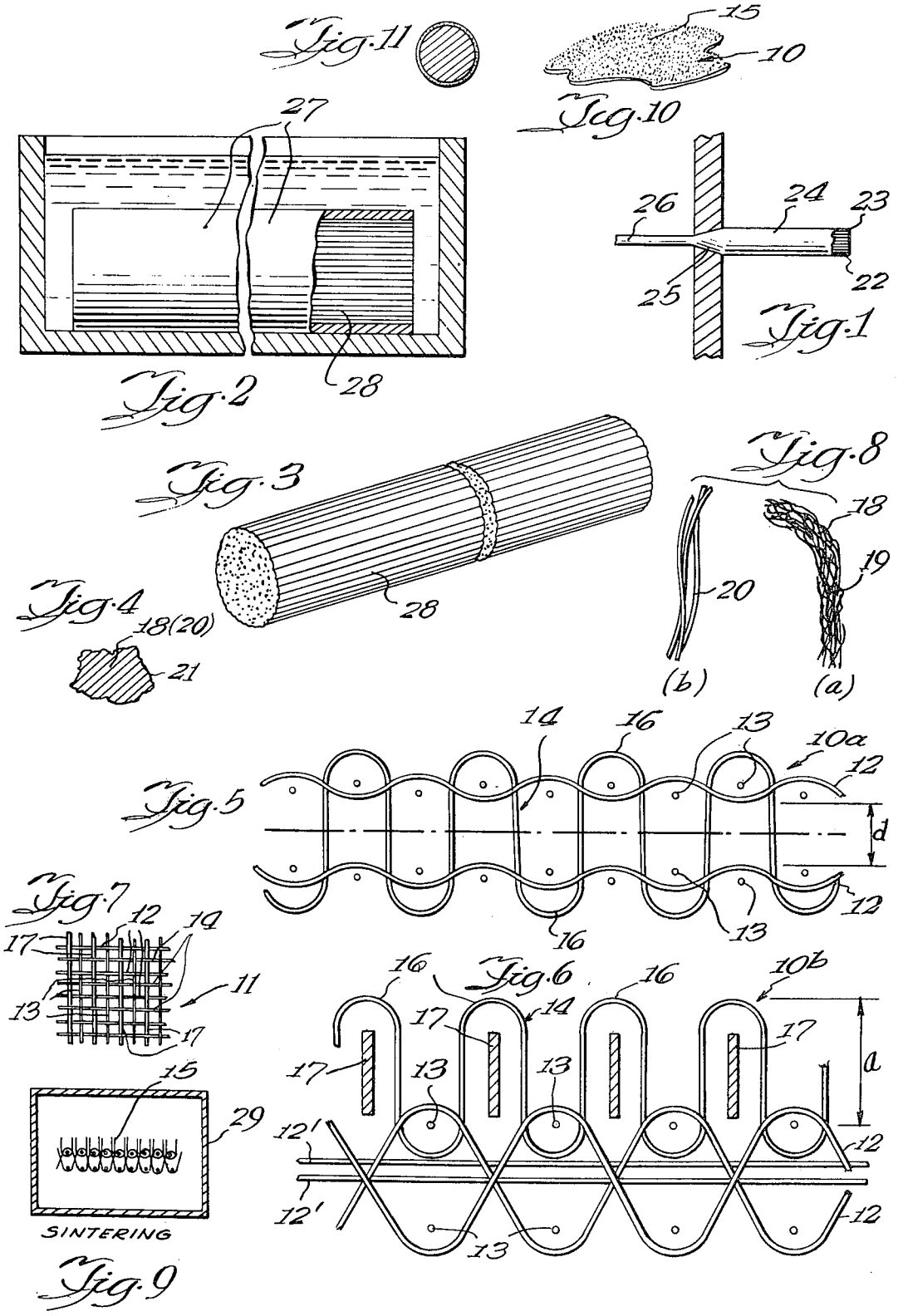
FIG. 1 is a schematic view illustrating a drawing step in the formation of metallic filaments for use in a velvet textile embodying the invention.
FIG. 2 is a schematic view illustrating a further step in the forming of the metallic filaments wherein the matrix material is removed.
FIG. 3 is a broken isometric view of a tow of filaments so formed.
FIG. 4 is an enlarged transverse cross-section of a filament illustrating the rough unmachined outer surface thereof.
FIG. 5 is a transverse section of a velvet fabric embodying the invention.
FIG. 6 is a transverse section of a modified form of velvet fabric embodying the invention.
FIG. 7 is a fragmentary face view of the fabric of FIG. 6.
FIG. 8 is a fragmentary enlarged elevation of yarns such as used in the velvet fabrics of FIGS. 5 and 6.
FIG. 9 is a schematic elevation of an apparatus for providing sintered bonds between the metallic portions of the fabric.
FIG. 10 is a fragmentary perspective view of a piece of velvet fabric embodying the invention.
FIG. 11 is a transverse cross-section of a coated fiber for use in the velvet fabric.

In the exemplary embodiment of the invention as disclosed in the drawing, a pile cloth generally designated 10 is shown to comprise a conventional plush or velvet textile fabric as may be formed on conventional textile forming apparatus. The velvet material 10, however, is provided with a metallic portion for imparting desirable characteristics. In the preferred form, the metallic portion of the velvet comprises metallic filaments or fibers distributed in the yarns of the woven fabric and/or pile. As illustrated in FIG. 7, in such velvet pile fabrics, the woven fabric generally designated 11 is formed of a plurality of vertical warp yarns 12 and horizontal filling, or weft, yarns 13. Conventionally, the warp yarns 12 are identified as ends and the filling yarns 13 are identified as picks. In forming the velvet material 10, a pile yarn 14 is introduced which extends outwardly from the surface of the fabric to define the plush or velvet surface 15, as shown in FIG. 10. The pile yarn may comprise an extra warp end or an extra filling pick as desired. Alternatively, illustratively the base fabric 11 may comprise a warp knitted fabric.

Referring to FIGS. 5 and 6, two different methods of forming such a velvet fabric are illustrated. Thus, in the velvet fabric 10a shown in FIG. 5, the warp ends 12 are interlaced in spaced relationship to two sets of filling picks, or weft yarns, 13. The pile yarn 14 is interlaced with the spaced filling picks 13 to define a plurality of outwardly disposed turned portions 16. The exposed ends 16 may be cut as by shearing or other suitable conventional cutting methods to define the desired plush or velvet surface 15.

In FIG. 6, another form of plush or velvet material **10*b* is shown to comprise a fabric wherein the warp ends 12 are interlaced about the filling picks 13 with additional warp ends 12' extending generally rectilinearly through the weave. The pile yarn 14 is interlaced only with the upper set of filling picks 13 and may be formed around suitable cutting knives 17 which, in the final step of forming the material, are moved outwardly to sever the turned portions 16. Thus, velvet material 10***a* and 10*b* comprises conventional forms of plush or velvet pile fabric material adapted to be manufactured on conventional textile machinery with minimum adjustment.

As indicated briefly above, the invention comprehends blending in of metallic, or metallic coated, fibers or filaments. Thus, as shown in FIG. 8*a*, the yarns may comprise staple length metal fibers 18 blended with conventional staple length textile fibers 19 which may comprise cotton, wool, plastics, etc.

If desired, the yarns may be formed of continuous metal filaments 20 as illustrated in FIG. 8*b*. In the preferred embodiment, the fibers 18 and filaments 20 are formed to have a rough unmachined, unburnished, fracture-free outer surface 21, as shown in FIG. 4, to provide an improved retention of the yarns in the velvet material 10. Referring to FIGS. 1–3, one highly desirable method of forming such yarns is by providing a plurality of metal rods 22 in a suitable matrix 23 to define a composite 24 which is suitably constricted. As shown in FIG. 1, the composite may be constricted by drawing through a suitable die 25 to produce a reduced composite 26. The composite may be successively reduced as many times as desired until the composite is reduced to a small size wherein the rods 22 are of filamentary diameter. Thus, as shown in FIG. 2, the final composite 27 may be one having filaments 28 therein of an extremely small size, such as down to 50 microns or less. It has been found that such a process produces fine filaments down to 1 micron, or less, in continuous lengths, such small filaments providing improved flexibility and usefulness in the velvet material 10 as such fine wires permit the use of substantially conventional textile apparatus in forming fabrics utilizing such filaments and fibers formed therefrom. An excellent example of a method of forming such filaments and fibers is that disclosed in Roberts et al. U.S. Pat. No. 3,394,213 issued July 23, 1968 for a Method of Forming Filaments, and owned by the assignee hereof, to which reference may be had for a detailed disclosure of such a method of forming the desirable rough, unmachined surfaced fibers.

As indicated above, the present invention comprehends providing the velvet material 10 with at least a portion of the yarns thereof formed of such metallic filaments or fibers. Illustratively, an excellent velvet material 10 may be formed of such filaments or fibers, where the warp ends 12 and filling picks 13 of the woven fabrics 11 are formed of stainless steel, said fibers having a diameter of approximately 25 microns down to 1 micron or less. The pile yarns may incorporate such metallic filaments or fibers having a diameter similar to the diameter of the woven fabric yarns or smaller. Where the fibers are provided as staple length metal fibers, they may be blended with conventional textile fibers, such as cotton, wool, plastics, etc. The blend may be one wherein the metal fibers are present in the ratio of from less than 1% to 100% by weight.

In forming such a spun blended yarn, the yarn may be provided with twist as desired. A manufacturer's twist may be utilized to provide a highly satisfactory blended yarn for this purpose. The rough outer surface of the fibers provides an improved interlocked association of the metal fibers with the organic fibers. Alternatively, the yarn may comprise a sliver yarn.

To provide a further improved retention of the metal fibers or filaments in the velvet material 10, the metal filaments or fibers may be metallurgically bonded such as by sintering, brazing, welding, etc., or adhesively bonded, as desired. More specifically, an improved strong woven fabric 11 may be formed by sintering the woven warp and filling yarns to form an effectively bonded joint at the points of contact. To assure a maintained distributed arrangement of the metal filaments or fibers, a sacrificial material may be blended therewith which is effectively removed during the sintering operation while maintaining the distributed arrangement of the metal filaments or fibers. Illustratively, such sacrificial material may comprise plastic material adapted to be burned out during the sintering operation. As will be obvious to those skilled in the art, other methods of removing the sacrificial material, such as chemical treatment, etc., may be employed depending upon the type of sacrificial material utilized.

The pile yarn 14 may similarly be bonded to the woven fabric yarns. The pile yarn may comprise a blend of metal filaments or fibers with suitable sacrificial nonmetallic fibers, as desired.

As will be obvious to those skilled in the art, other methods of bonding, such as brazing or nonmetallurgical securing, such as by adhesive and cements, may be utilized as desired. The adhesive material may comprise electrically conductive material as desired.

The sintering operation may be carried out in a conventional sintering apparatus, such as apparatus 29 shown in FIG. 9. As shown therein, it is preferred that the cutting of the pile yarns to define the plush or velvet surface 15 be performed prior to the sintering operation.

As indicated above, the metal filaments may be made extremely small in diameter to provide desired flexibility and to provide blending characteristics in the yarn. Illustratively, the warp ends and filling picks may be formed from filaments 28 provided in tows, such as 8 micron 300 end, 12 micron 90 end, 12 micron 300 end, 25 micron 90 end, 4 micron 1000 end, 2 micron 1000 end, 4 micron 5000 end, 2 micron 5000 end tows, etc. Such tows preferably are provided with a suitable twist for facilitated weaving. The pile material, illustratively, may be formed of tows such as 2 micron 300, 1000, 5000, etc., end, 4 micron 300, 1000, 5000, etc. end, 8 micron 300, etc. end tows, which similarly may be provided with suitable twists, such as 2 to 5 turns per inch twists as desired.

As shown in FIG. 5, and as indicated briefly above, the filling picks 13 may be provided in spaced planar arrangements which are spaced apart a preselected distance. The spacing d as indicated may vary from approximately 0.020 inch to approximately ½ inch. The extension of the pile fibers from the woven fabric base may, illustratively, be approximately 0.010 to 8 inches as desired.

The metal material of the different yarns may be varied as desired. Illustratively, the pile yarn for certain decorative purposes may be formed of a precious metal, such as gold, within the scope of the invention. The yarns may be formed of aluminum which may be selectively color anodized to provide different aesthetic effects as desired. Thus, different selections of the metallic materials may be made as desired by the user not only for mechanical properties considerations, but also for aesthetic considerations, etc.

The invention comprehends the provision of a velvet material 10 as a fabric wherein each of the pile yarn 14 and the fabric base 11 are 100 percent metallic. Alternatively, the pile yarn 14 may comprise a blended yarn having only a portion thereof metallic, for use with a fabric base formed of 100 percent metallic yarns. Further alternatively, the invention comprehends the provision of such a velvet material wherein each of the fabric base and pile yarns are blended yarns. Still further alternatively, the invention comprehends the provision of such a velvet material wherein the pile yarn 14 is 100 percent metallic and the fabric base 11 is a blended yarn base. With reference to the fabric base 11, the warp ends and the filling picks may selectively be 100 percent metallic or blended yarns as desired. The improved interlocking of the fibers to provide an extended life velvet material is obtained as a result of the rough unmachined, unburnished fracture-free outer surfaces of the metal fibers utilized, whether the fibers comprise 100 percent of the yarn or are blended with the other nonmetallic fibers as discussed above.

For facilitated forming of the velvet where the smaller diameter filaments or fibers are utilized, such as the fibers 4 microns and smaller, it may be desirable to provide the yarn originally as an unleached composite wherein the filaments or fibers are retained in a surrounding matrix body. The composite may be woven into the velvet as a yarn and upon completion of the weaving, the matrix material may be removed as by leaching to free the individual small diameter filaments or fibers in the form of a tow. Obviously, such composite formation may be utilized in connection with the yarns of the fabric base as well as with the yarns of the pile portions of the velvet.

One of the improved features of the velvet fabric resulting from the use of the metal filaments or fibers therein is the ability thereof to dissipate static electricity and the like. To effect such dissipation, it is not necessary that the fibers be in metal-to-metal contact, as long as they are sufficiently closely spaced to permit the static electricity to discharge successively through the spaced ones of the fibers or filaments. Obviously, where the metal fibers or filaments are disposed in metal-to-metal contact, the static electricity may similarly be deposited through the resultant electrically conducted path.

Thus, as indicated above, the invention comprehends utilizing fibers and filaments which may comprise insulating core elements provided with an outer surface portion of an electrically conducting material such as a metal coating. Here, again, the static electricity discharge may be provided selectively by a discontinuous static electric discharge path provided by a distribution of the coated spaced fibers in sufficiently spaced proximity as well as by the provision of the coated fibers in metal-to-metal contact.

The foregoing disclosure of specific embodiments is illustrative of the broad inventive concepts comprehended by the invention.

We claim:

1. A velvet fabric made essentially solely of metal and comprising a base, pile connected to the base, the velvet fabric being formed of a plurality of textile metal fibers, each fiber having a diameter of less than 50 microns and a rough, unmachined, unburnished, fracture free outer surface.

2. The fabric of claim 1 wherein each of the metal fibers has a diameter ranging from about 1 micron to about 25 microns.

3. The fabric of claim 1 wherein the metal fibers are made of stainless steel.

4. The fabric of claim 1 wherein the base is a knitted fabric.

5. The fabric of claim 4 wherein the fiber is a continuous filament.

6. The fabric of claim 4 wherein the fibers are staple fibers.

7. The fabric of claim 1 wherein the base is woven.

8. The fabric of claim 7 wherein the fiber is a continuous filament.

9. The fabric of claim 7 wherein the fibers are staple fibers.

10. The fabric of claim 1 wherein at least a portion of the fibers are metallurgically bonded together.

11. A velvet fabric made essentially solely of metal fibers having a diameter of less than 50 microns and a rough, unmachined, unburnished, fracture free outer surface, the fabric comprising a base knitted from a yarn made of said fibers and pile connected to the base and made from said fibers.

12. The fabric of claim 11 wherein the diameter of the metal fibers range between about 1 micron to about 25 microns.

13. The fabric of claim 11 wherein the metal fibers are made of stainless steel.

14. The fabric of claim 11 wherein at least a portion of the metal fibers are metallurgically bonded together.

15. The fabric of claim 11 wherein the metal fibers are staple fibers.

16. The fabric of claim 11 wherein the metal fibers are continuous filaments.

17. A velvet fabric made essentially solely of metal fibers having a diameter of less than 50 microns and a rough, unmachined, unburnished, fracture free surface, the fabric comprising a base woven from warp and filling yarns made from said fibers and a pile connected to the base and made from said fibers.

18. The fabric of claim 17 wherein the diameter of the metal fibers range between about 1 micron to about 25 microns.

19. The fabric of claim 17 wherein the metal fibers are made of stainless steel.

20. The fabric of claim 17 wherein at least a portion of the metal fibers are metallurgically bonded together.

21. The fabric of claim 17 wherein the metal fibers are staple fibers.

22. The fabric of claim 17 wherein the metal fibers are continuous filaments.

23. A velvet fabric formed of metal comprising:

a base fabric comprising interlaced warp yarns and filling yarns electrically connected to each other; and cut pile yarns interlocked with said base fabric and electrically connected thereto forming a pile surface projecting from one surface of the base fabric, each of said yarns being formed of a plurality of textile metal filaments, each of said filaments exhibiting a surface defined as rough, unmachined, unburnished and fracture free.

* * * * *